US010443558B2

(12) United States Patent
Ransom et al.

(10) Patent No.: US 10,443,558 B2
(45) Date of Patent: Oct. 15, 2019

(54) LUBRICANTS WITH CALCIUM AND MAGNESIUM-CONTAINING DETERGENTS AND THEIR USE FOR IMPROVING LOW-SPEED PRE-IGNITION AND FOR CORROSION RESISTANCE

(71) Applicant: Afton Chemical Corporation, Richmond, VA (US)

(72) Inventors: Paul Ransom, Huddersfield (GB); Guillaume Carpentier, Berkshire (GB); Kristin Fletcher, Midlothian, VA (US)

(73) Assignee: AFTON CHEMICAL CORPORATION, Richmond, VA (US)

( * ) Notice: Subject to any disclaimer, the term of this patent is extended or adjusted under 35 U.S.C. 154(b) by 190 days.

(21) Appl. No.: 15/409,509

(22) Filed: Jan. 18, 2017

(65) Prior Publication Data

US 2018/0201860 A1 Jul. 19, 2018

(51) Int. Cl.

| | |
|---|---|
| ***F02P 5/02*** | (2006.01) |
| ***C10M 159/20*** | (2006.01) |
| ***C10M 159/22*** | (2006.01) |
| ***C10M 159/24*** | (2006.01) |

(52) U.S. Cl.

CPC ..... *F02P 5/02* (2013.01); *C10M 159/20* (2013.01); *C10M 159/22* (2013.01); *C10M 159/24* (2013.01); *C10M 2207/028* (2013.01); *C10M 2219/046* (2013.01); *C10M 2227/00* (2013.01); *C10N 2210/02* (2013.01); *C10N 2210/06* (2013.01); *C10N 2230/12* (2013.01); *C10N 2230/44* (2013.01); *C10N 2230/52* (2013.01); *C10N 2230/54* (2013.01); *C10N 2230/76* (2013.01); *C10N 2240/10* (2013.01); *C10N 2240/104* (2013.01)

(58) Field of Classification Search

CPC ..... F02P 5/02; C10M 159/20; C10M 159/22; C10M 159/24; C10M 2219/046; C10M 2227/00; C10M 2210/02; C10N 2230/52; C10N 2230/12; C10N 2240/10; C10N 2210/06; C10N 2230/44; C10N 2230/54; C10N 2230/76; C10N 2240/104; C10N 2210/02

See application file for complete search history.

(56) References Cited

U.S. PATENT DOCUMENTS

| | | | |
|---|---|---|---|
| 3,185,647 | A | 5/1965 | Anderson et al. |
| 3,189,544 | A | 6/1965 | Hyman et al. |
| 3,256,185 | A | 6/1966 | Le Suer |
| 3,278,550 | A | 10/1966 | Norman et al. |
| 3,312,619 | A | 4/1967 | Dale |
| 3,366,569 | A | 1/1968 | Norman et al. |
| 3,390,086 | A | 6/1968 | Rosemary et al. |
| 3,403,102 | A | 9/1968 | Le Suer |
| 3,458,530 | A | 7/1969 | Siegel et al. |
| 3,470,098 | A | 9/1969 | O'Halloran |
| 3,502,677 | A | 3/1970 | Sner |
| 3,519,564 | A | 7/1970 | Vogel |
| 3,546,243 | A | 12/1970 | Coupland |
| 3,573,205 | A | 3/1971 | Lowe et al. |
| 3,634,515 | A | 1/1972 | Piasek et al. |
| 3,649,229 | A | 3/1972 | Otto |
| 3,708,552 | A | 1/1973 | Kunii et al. |
| 3,718,663 | A | 2/1973 | Lee et al. |
| 3,749,695 | A | 7/1973 | De Vries |
| 3,859,318 | A | 1/1975 | Le Suer |
| 3,865,740 | A | 2/1975 | Goldschmidt |
| 3,865,813 | A | 2/1975 | Gergel |
| 3,954,639 | A | 5/1976 | Liston |
| 4,152,499 | A | 5/1979 | Boerzel et al. |
| 4,234,435 | A | 11/1980 | Meinhardt et al. |
| 4,259,194 | A | 3/1981 | DeVries et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | DeVries et al. |

(Continued)

FOREIGN PATENT DOCUMENTS

| | | |
|---|---|---|
| EP | 0317348 A1 | 5/1989 |
| EP | 0612839 A1 | 8/1994 |

(Continued)

OTHER PUBLICATIONS

European Office Action; dated Jul. 30, 2018 for EP Application No. EP16 741 792.2.

European Office Action; dated Aug. 14, 2018 for EP Application No. EP16 741 797.1.

Final Office Action; dated Jun. 8, 2018 for U.S. Appl. No. 15/147,330.

Non-Final Office Action; dated Jun. 21, 2018 for U.S. Appl. No. 15/409,513.

Non-Final Office Action; dated Oct. 1, 2018 for U.S. Appl. No. 15/147,317.

Non-Final Office Action; dated Oct. 1, 2018 for U.S. Appl. No. 15/147,375.

(Continued)

*Primary Examiner* — Cephia D Toomer

(74) *Attorney, Agent, or Firm* — Mendelsohn Dunleavy, P.C.

(57) ABSTRACT

A lubricating oil composition and method of operating a boosted internal combustion engine with reduced low-speed pre-ignition events and corrosion resistance. The oil composition includes a base oil, one or more overbased calcium sulfonate detergents, one or more overbased calcium phenate detergents, and one or more overbased magnesium-containing detergents. A ratio of ppm of calcium to TBN of the oil composition is less than 170; a ratio of ppm of magnesium to total soap content in wt. % is greater than 700; and there are limited amounts of boron and molybdenum, and all weight percentages and ppm values being based on the total weight of the oil composition. The compositions give low LSPI ratios and pass the Ball Rust test.

22 Claims, No Drawings

(56) References Cited

U.S. PATENT DOCUMENTS

| | | | |
|---|---|---|---|
| 4,272,387 | A | 6/1981 | King et al. |
| 4,283,295 | A | 8/1981 | DeVries et al. |
| 4,285,822 | A | 8/1981 | DeVries et al. |
| 4,379,064 | A | 4/1983 | Cengel et al. |
| 4,482,464 | A | 11/1984 | Karol et al. |
| 4,521,318 | A | 6/1985 | Karol |
| 4,554,086 | A | 11/1985 | Karol et al. |
| 4,579,675 | A | 4/1986 | Sawicki et al. |
| 4,612,132 | A | 9/1986 | Wollenberg et al. |
| 4,614,522 | A | 9/1986 | Buckley |
| 4,614,603 | A | 9/1986 | Wollenberg |
| 4,617,137 | A | 10/1986 | Plavac |
| 4,617,138 | A | 10/1986 | Wollenberg |
| 4,636,322 | A | 1/1987 | Nalesnik |
| 4,645,515 | A | 2/1987 | Wollenberg |
| 4,647,390 | A | 3/1987 | Buckley, III et al. |
| 4,648,886 | A | 3/1987 | Buckley, III et al. |
| 4,648,980 | A | 3/1987 | Erdman |
| 4,652,387 | A | 3/1987 | Andress, Jr. et al. |
| 4,663,062 | A | 5/1987 | Wollenberg |
| 4,663,064 | A | 5/1987 | Nalesnik et al. |
| 4,666,459 | A | 5/1987 | Wollenberg |
| 4,666,460 | A | 5/1987 | Wollenberg |
| 4,668,246 | A | 5/1987 | Wollenberg |
| 4,670,170 | A | 6/1987 | Wollenberg |
| 4,699,724 | A | 10/1987 | Nalesnik et al. |
| 4,713,189 | A | 12/1987 | Nalesnik et al. |
| 4,713,191 | A | 12/1987 | Nalesnik |
| 4,857,214 | A | 8/1989 | Papay et al. |
| 4,948,386 | A | 8/1990 | Sung et al. |
| 4,963,275 | A | 10/1990 | Gutierrez et al. |
| 4,963,278 | A | 10/1990 | Blain et al. |
| 4,971,598 | A | 11/1990 | Andress et al. |
| 4,971,711 | A | 11/1990 | Lundberg et al. |
| 4,973,412 | A | 11/1990 | Migdal et al. |
| 4,981,492 | A | 1/1991 | Blain et al. |
| 5,026,495 | A | 6/1991 | Emert et al. |
| 5,030,249 | A | 7/1991 | Herbstman |
| 5,039,307 | A | 8/1991 | Herbstman et al. |
| 5,137,647 | A | 8/1992 | Karol |
| 5,204,012 | A | 4/1993 | Schaffhausen |
| 5,241,003 | A | 8/1993 | Degonia et al. |
| 5,334,321 | A | 8/1994 | Harrison et al. |
| 5,498,355 | A * | 3/1996 | Perozzi ..... C10M 133/56 508/194 |
| 5,650,381 | A | 7/1997 | Gatto et al. |
| 5,658,862 | A | 8/1997 | Vrahopoulou |
| 5,739,355 | A | 4/1998 | Gateau et al. |
| 5,804,537 | A | 9/1998 | Boffa et al. |
| 5,883,057 | A | 3/1999 | Roell, Jr. et al. |
| 6,004,910 | A | 12/1999 | Bloch et al. |
| 6,034,040 | A | 3/2000 | Ozbalik et al. |
| 6,140,282 | A | 10/2000 | Cartwright et al. |
| RE37,363 | E | 9/2001 | Gatto et al. |
| 6,300,291 | B1 | 10/2001 | Hartley et al. |
| 6,329,328 | B1 | 12/2001 | Koganei et al. |
| 6,569,818 | B2 | 5/2003 | Nakazato et al. |
| 6,723,685 | B2 | 4/2004 | Hartley et al. |
| RE38,929 | E | 1/2006 | Gatto et al. |
| 7,214,649 | B2 | 5/2007 | Loper et al. |
| RE40,595 | E | 12/2008 | Gatto et al. |
| 7,645,726 | B2 | 1/2010 | Loper |
| 7,727,943 | B2 | 6/2010 | Brown et al. |
| 7,732,390 | B2 | 6/2010 | Kadkhodayan et al. |
| 7,897,696 | B2 | 3/2011 | Huang et al. |
| 8,048,831 | B2 | 11/2011 | Loper |
| 8,586,517 | B2 | 11/2013 | Waynick |
| 8,999,905 | B2 | 4/2015 | Duggal |
| 9,528,074 | B2 | 12/2016 | Hogendoorn |
| 10,155,915 | B2 | 12/2018 | Tamura |
| 2002/0019320 | A1 | 2/2002 | Nakazato et al. |
| 2002/0038525 | A1 | 4/2002 | Callis et al. |
| 2002/0151441 | A1 | 10/2002 | Srinivasan et al. |
| 2004/0176260 | A1 | 9/2004 | Shirahama et al. |
| 2006/0084582 | A1 | 4/2006 | Wells et al. |
| 2006/0116299 | A1 | 6/2006 | Arrowsmith et al. |
| 2006/0223718 | A1 | 10/2006 | Bastien et al. |
| 2006/0276352 | A1 | 12/2006 | Vinci |
| 2007/0119390 | A1 | 5/2007 | Herrmann et al. |
| 2008/0009426 | A1 | 1/2008 | Iyer et al. |
| 2008/0110797 | A1 | 5/2008 | Fyfe et al. |
| 2008/0194440 | A1 | 8/2008 | Ravichandran et al. |
| 2008/0223330 | A1 | 9/2008 | Lam et al. |
| 2008/0248981 | A1 | 10/2008 | Matsui et al. |
| 2008/0280796 | A1 | 11/2008 | Guinther et al. |
| 2008/0318817 | A1 | 12/2008 | Yagishita |
| 2009/0082233 | A1 | 3/2009 | Kasi |
| 2009/0318318 | A1 | 12/2009 | Mathur et al. |
| 2010/0035774 | A1 | 2/2010 | Growcott |
| 2011/0077181 | A1 | 3/2011 | Yagishita |
| 2011/0239972 | A1 | 10/2011 | Kamano et al. |
| 2011/0245120 | A1 | 10/2011 | Bertram et al. |
| 2012/0202723 | A1 | 8/2012 | Abbey et al. |
| 2014/0274840 | A1 | 9/2014 | Esche et al. |
| 2015/0034047 | A1 | 2/2015 | Yaguchi et al. |
| 2015/0133352 | A1 | 5/2015 | Esche et al. |
| 2015/0175924 | A1 | 6/2015 | Dance et al. |
| 2015/0307802 | A1 | 10/2015 | Ritchie et al. |
| 2015/0322367 | A1 | 11/2015 | Patel et al. |
| 2015/0322368 | A1 | 11/2015 | Patel et al. |
| 2015/0322369 | A1 | 11/2015 | Patel et al. |
| 2016/0326453 | A1 | 11/2016 | Galic Raguz et al. |
| 2017/0015929 | A1 | 1/2017 | Fletcher et al. |
| 2017/0022441 | A1 | 1/2017 | Onodera et al. |
| 2017/0130158 | A1 | 5/2017 | Tamura |
| 2017/0168982 | A1 | 6/2017 | Tamura et al. |
| 2017/0204348 | A1 | 7/2017 | Tamura |
| 2017/0298287 | A1 | 10/2017 | Tamura |
| 2018/0044610 | A1 | 2/2018 | Mayhew et al. |
| 2018/0087001 | A1 | 3/2018 | Mosier et al. |

FOREIGN PATENT DOCUMENTS

| | | | |
|---|---|---|---|
| EP | 0638632 | B1 | 3/2000 |
| EP | 1795582 | A2 | 6/2007 |
| EP | 2371934 | A1 | 10/2011 |
| EP | 2940110 | A1 | 11/2015 |
| EP | 3101095 | A1 | 12/2016 |
| GB | 1065595 | A1 | 4/1967 |
| GB | 2140811 | A1 | 12/1984 |
| JP | 2014152301 | A | 8/2014 |
| JP | 2014152301 | A1 | 8/2014 |
| WO | 2015023559 | A1 | 2/2015 |
| WO | 2015042337 | A1 | 3/2015 |
| WO | 2015042340 | A1 | 3/2015 |
| WO | 2015042341 | A1 | 3/2015 |
| WO | WO2015042337 | A1 | 3/2015 |
| WO | WO2015042340 | A1 | 3/2015 |
| WO | WO2015114920 | A1 | 8/2015 |
| WO | WO2015152226 | A1 | 10/2015 |
| WO | WO2015171981 | A1 | 11/2015 |
| WO | WO2016043333 | A1 | 3/2016 |
| WO | WO2016152995 | A1 | 9/2016 |
| WO | WO2016154167 | A1 | 9/2016 |
| WO | WO2016159185 | A1 | 10/2016 |
| WO | WO2017011687 | A1 | 1/2017 |

OTHER PUBLICATIONS

Non-Final Office Action; dated Oct. 1, 2018 for U.S. Appl. No. 15/147,464.

Final Office Action; dated Jul. 20, 2018 for U.S. Appl. No. 15/147,404.

International Search Report and Written Opinion; dated Jan. 25, 2018 for PCT Application No. PCT/US2017/060959.

Jennings, M. G., "Technical Bulletin—TBN in Diesel Engine Oils," Chevron, Feb. 2012 as retrieved on Jan. 16, 2018 from: http://www.championbrands.com/Tech%20Bulletin%20TBN-Chevron.pdf; XP055441436.

International Search Report and Written Opinion; dated Jan. 15, 2018 for PCT Application No. PCT/US2017/060956.

Ethyl Safety Data Sheet "HiTec 7169: Secondary ZDDP," 2000, 1 page.

(56) References Cited

OTHER PUBLICATIONS

Kagaya, Mineo, and Sakae Ishikawa. An evaluation and optimization of lubricants for turbocharged gasoline engines. No. 840261. SAE Technical Paper, 1984.
Ethyl Product Data Sheet "HiTEC 611: Overbase Calcium Sulphonate Detergent," 1991, 2 pages.
The Afton Chemical Grease Portfolio, "Grease," Afton Chemical Corporation, 2016, 12 pages.
Non-Final Office Action; dated Feb. 23, 2018 for U.S. Appl. No. 15/147,404.
Final Office Action; dated Jan. 16, 2018 for U.S. Appl. No. 15/409,513.
Non-Final Office Action; dated Dec. 6, 2017 for U.S. Appl. No. 15/147,330.
Office Communication Concerning Third Party Submission; dated Feb. 22, 2018 for U.S. Appl. No. 15/147,404.
International Search Report and Written Opinion; dated Feb. 9, 2018 for PCT Application No. PCT/US2017/060957.
International Search Report and Written Opinion; dated Jun. 9, 2017 for PCT Application No. PCT/US2017/023622.
International Search Report with Written Opinion: dated Jun. 21, 2017 for PCT Application No. PCT/US2017/015279.
Final Office Action; dated May 24, 2017 for U.S. Appl. No. 15/147,330.
Dahnz, Christoph, et al. "Investigations on pre-ignition in highly supercharged SI engines." SAE International Journal of Engines 3.1 (2010): 214-224.
Zahdeh, Akram, et al. "Fundamental approach to investigate pre-ignition in boosted SI engines." SAE International Journal of Engines 4.1 (2011): 246-273.
Takeuchi, Kazuo, et al. "Investigation of engine oil effect on abnormal combustion in turbocharged direct injection-spark ignition engines." SAE International Journal of Fuels and Lubricants 5.3 (2012): 1017-1024.
Palaveev, Stefan, et al. "Premature Flame Initiation in a Turbocharged DISI Engine-Numerical and Experimental Investigations." SAE International Journal of Engines 6.1 (2013): 54-66.
Hirano, Satoshi, et al. Investigation of Engine Oil Effect on Abnormal Combustion in Turbocharged Direct Injection-Spark Ignition Engines (Part 2). No. 2013-01-2569. SAE Technical Paper, 2013.
Okada, Yoshihiro, et al. "Study of low-speed pre-ignition in boosted spark ignition engine." SAE International Journal of Engines 7.2 (2014): 584-594.
Dingle, Simon F., et al. Lubricant induced pre-ignition in an optical SI engine. No. 2014-01-1222. SAE Technical Paper, 2014.
Qi, Yunliang, et al. The effect of oil intrusion on super knock in gasoline engine. No. 2014-01-1224. SAE Technical Paper, 2014.
Ohtomo, Mitsuaki, et al. "Pre-ignition of gasoline-air mixture triggered by a lubricant oil droplet." SAE International Journal of Fuels and Lubricants 7.3 (2014): 673-682.
Fujimoto, Kosuke, et al. "Engine oil development for preventing pre-ignition in turbocharged gasoline engine." SAE International Journal of Fuels and Lubricants 7.3 (2014): 869-874.
Moriyoshi, Yasuo, et al. "A Study of Low Speed Preignition Mechanism in Highly Boosted SI Gasoline Engines." SAE International Journal of Engines 9.2015-01-1865 (2015).
"Relative Impact of Chemical and Physical Properties of the Oil-Fuel Droplet on Pre-Ignition and Superknock in Turbocharged Gasoline Engines," SAE 2016 Powertrain Baltimore—Manuscript—Droplet Pre-ignition_v10, pp. 1-12.
Ritchie, Andrew, Doyle Boese, and Anne W. Young. "Controlling Low-Speed Pre-Ignition in Modern Automotive Equipment Part 3: Identification of Key Additive Component Types and Other Lubricant Composition Effects on Low-Speed Pre-Ignition." SAE International Journal of Engines 9.2016-01-0717 (2016).
Mayer, Mattias, et al. "Influence of Different Oil Properties on Low-Speed Pre-Ignition in Turbocharged Direct Injection Spark Ignition Engines," No. 2016-01-0718. SAE Technical Paper, 2016.
Andrews, Arthur, et al. "Investigation of Engine Oil Base Stock Effects on Low Speed Pre-Ignition in a Turbocharged Direct Injection SI Engine," No. 2016-01-9071. SAE Technical Paper, 2016.
Fletcher, K. A. et al. "Engine Oil Additive Impacts on Low Speed Preignition," Afton Chemical Corp. SAE International, 2016, 7 pages.
EO LSPI IP Discussion Presentation, Feb. 9, 2015, 11 pages.
Update: EO LSPI IP Filing Plan Presentation, Mar. 17, 2015, pp. title-35.
Onodera, Ko, et al. Engine Oil Formulation Technology to Prevent Pre-ignition in Turbocharged Direct Injection Spark Ignition Engines. No. 2015-01-2027. SAE Technical Paper, 2015.
Elliott, Ian, et al. Understanding Low Speed Pre-Ignition Phenomena across Turbo-Charged GDI Engines and Impact on Future Engine Oil Design. No. 2015-01-2028. SAE Technical Paper, 2015.
Long, Yan, et al. Effect of Oil and Gasoline Properties on Pre-Ignition and Super-Knock in a Thermal Research Engine (TRE) and an Optical Rapid Compression Machine (RCM). No. 2016-01-0720. SAE Technical Paper, 2016.
Tamura, Kazushi, et al. "Abnormal Combustion Induced by Combustion Chamber Deposits Derived from Engine Oil Additives in a Spark-Ignited Engine." SAE International Journal of Engines 8.1 (2015): 200-205.
Non-Final Office Action; dated May 11, 2016 for U.S. Appl. No. 15/053,617.
Non-Final Office Action; dated Dec. 20, 2016 for U.S. Appl. No. 15/147,330.
International Search Report and Written Opinion; dated Oct. 6, 2016 for PCT Application No. PCT/US2016/042220.
Non-Final Office Action; dated Sep. 6, 2017 for U.S. Appl. No. 15/409,513.
Non-Final Office Action; dated Sep. 6, 2017 for U.S. Appl. No. 15/047,934.
Non-Final Office Action; dated Nov. 16, 2018 for U.S. Appl. No. 15/147,330.
Non-Final Office Action; dated Jan. 8, 2019 for U.S. Appl. No. 15/409,503.
Final Office Action; dated Feb. 21, 2019 for U.S. Appl. No. 15/147,375.
Final Office Action; dated Jan. 11, 2019 for U.S. Appl. No. 15/409,513.
Non-Final Office Action; dated Jan. 23, 2019 for U.S. Appl. No. 15/409,516.
Non-Final Office Action; dated Feb. 21, 2019 for U.S. Appl. No. 15/409,514.
Written Opinion for Singapore Patent Application No. 11201800205T; dated Mar. 12, 2019.
Written Opinion for Singapore Patent Application No. 11201800279V; dated Mar. 12, 2019.
Final Office Action for U.S. Appl. No. 15/147,464; dated Apr. 30, 2019.

* cited by examiner

LUBRICANTS WITH CALCIUM AND MAGNESIUM-CONTAINING DETERGENTS AND THEIR USE FOR IMPROVING LOW-SPEED PRE-IGNITION AND FOR CORROSION RESISTANCE

TECHNICAL FIELD

The disclosure relates to lubricating oil compositions containing one or more oil soluble additives and the use of such lubricating oil compositions to improve low-speed pre-ignition while maintaining corrosion resistance.

BACKGROUND

Turbocharged or supercharged engines (i.e. boosted internal combustion engines) may exhibit an abnormal combustion phenomenon known as stochastic pre-ignition or low-speed pre-ignition (or "LSPI"). LSPI is a pre-ignition event that may include very high pressure spikes, early combustion during an inappropriate crank angle, and knock. All of these, individually and in combination, have the potential to cause degradation and/or severe damage to the engine. However, because LSPI events occur only sporadically and in an uncontrolled fashion, it is difficult to identify the causes for this phenomenon and to develop solutions to suppress it.

Pre-ignition is a form of combustion that results of ignition of the air-fuel mixture in the combustion chamber prior to the desired ignition of the air-fuel mixture by the igniter. Pre-ignition has typically been a problem during high speed engine operation since heat from operation of the engine may heat a part of the combustion chamber to a sufficient temperature to ignite the air-fuel mixture upon contact. This type of pre-ignition is sometimes referred to as hot-spot pre-ignition.

More recently, intermittent abnormal combustion has been observed in boosted internal combustion engines at low-speeds and medium-to-high loads. For example, during operation of the engine at 3,000 rpm or less, under load, with a brake mean effective pressure (BMEP) of at least 10 bar, low-speed pre-ignition (LSPI) may occur in a random and stochastic fashion. During low-speed engine operation, the compression stroke time is longest.

Several published studies have demonstrated that turbocharger use, engine design, engine coatings, piston shape, fuel choice, and/or engine oil additives may contribute to an increase in LSPI events. One theory suggests that auto-ignition of engine oil droplets that enter the engine combustion chamber from the piston crevice (the space between the top of the piston ring pack and top of the piston) may be one cause of LSPI events.

In addition, there is also a need for reducing or preventing rust in the lubricated parts of a boosted engine to maintain engine performance. One way to reduce LSPI events is to reduce the total amount of detergent. However, since detergent tends to have an anti-corrosive effect, reducing the amount of detergent may increase corrosion. Accordingly, there is a need for engine oil additive components and/or combinations that are effective to not only reduce or eliminate LSPI but also maintain a desired level of anticorrosive effect in boosted internal combustion engines.

SUMMARY AND TERMS

The present disclosure relates to a lubricating oil composition and method of operating a boosted internal combustion engine. The lubricating oil composition includes greater than 50 wt. % of a base oil of lubricating viscosity, based on a total weight of the lubricating oil composition, one or more overbased calcium sulfonate detergents having a total base number of greater than 225 mg KOH/g, measured by the method of ASTM D-2896, one or more overbased calcium phenate detergents having a total base number of greater than 170 mg KOH/g, measured by the method of ASTM D-2896 and one or more overbased magnesium-containing detergents. A ratio of the amount of calcium in ppm to the total base number of the lubricant composition measured by the method of ASTM D-2896 is less than 170. A ratio of magnesium in ppm to total soap content in wt. %, based on a total weight of the lubricating oil composition, is greater than 700. An amount of boron in the lubricating oil composition is less than 300 ppm by weight; an amount of molybdenum in the lubricating oil composition is less than 330 ppm by weight. The lubricating oil composition may be effective to reduce a number of low-speed pre-ignition events in the boosted internal combustion engine lubricated with the lubricating oil composition relative to a number of low-speed pre-ignition events in the boosted internal combustion engine for a reference oil C-1.

In another embodiment, the disclosure provides a method for reducing low-speed pre-ignition events in a boosted internal combustion engine. The method includes a step of lubricating the boosted internal combustion engine with a lubricating oil composition including greater than 50 wt. % of a base oil of lubricating viscosity, based on a total weight of the lubricating oil composition, one or more overbased calcium sulfonate detergents having a total base number of greater than 225 mg KOH/g, measured by the method of ASTM D-2896, one or more overbased calcium phenate detergents having a total base number of greater than 170 mg KOH/g, measured by the method of ASTM D-2896 and one or more overbased magnesium-containing detergents. In this method, a ratio of the amount of calcium in ppm to total base number of the lubricating oil composition measured by the method of ASTM D-2896 is less than 170, a ratio of magnesium in ppm to total soap content in wt. %, based on a total weight of the lubricating oil composition, is greater than 700, an amount of boron in the lubricating oil composition is less than 300 ppm by weight, an amount of molybdenum in the lubricating oil composition is less than 330 ppm by weight. The boosted internal combustion engine is operated while lubricated with the lubricating oil composition whereby a number of low-speed pre-ignition events in the engine lubricated with the lubricating oil composition may be reduced relative to a number of low-speed pre-ignition events in the boosted internal combustion engine operated while lubricated with a reference oil C-1.

In each of the foregoing embodiments, the lubricating step of the method may lubricate a combustion chamber or cylinder walls of a spark-ignited direct injection internal combustion engine or spark-ignited port fuel injection internal combustion engine provided with a turbocharger or a supercharger. In each of the foregoing embodiments, the method may further comprise a step of measuring a number of low-speed pre-ignition events of the internal combustion engine lubricated with the lubricating oil composition.

In each of the foregoing embodiments, the base oil can be at least one selected from the group consisting of a Group II base oil, a Group III base oil, a Group IV base oil and a Group V base oil. In each of the foregoing embodiments, the lubricating oil composition may comprise greater than 50 wt. % of a Group II base oil, a Group III base oil or a combination thereof, or greater than 80 wt. % or greater than 90 wt. % of a Group II base oil, a Group III base oil or a combination thereof.

In each of the foregoing embodiments, the reduction of low-speed pre-ignition (LSPI) events may be expressed as a ratio of the number of LSPI events of a test oil relative to the number of LSPI events of a reference oil C-1 (hereinafter "the LSPI Ratio"), wherein the reference oil C-1 includes an overbased calcium-containing detergent as the sole detergent in the lubricating oil composition in an amount that provides about 2400 ppm calcium to the lubricating oil composition. In each of the foregoing embodiments, the reduction of the number of LSPI events may be greater than a 50% reduction and the number of LSPI events are a number of LSPI counts during 25,000 engine cycles, wherein the engine is operated at 2000 revolutions per minute with a brake mean effective pressure of 1,800 kPa. In each of the foregoing embodiments, the reduction of the number of LSPI events may be greater than an 85% reduction or may be 90% or greater reduction. In each of the foregoing embodiments, the reduction of LSPI events may be 93% or greater reduction. In each of the foregoing embodiments, the reduction of LSPI events may be 96% or greater reduction.

In each of the foregoing embodiments, the one or more magnesium-containing detergents may be overbased magnesium-containing detergents having a total base number of greater than 225 mg KOH/g measured by the method of ASTM D-2896 and the one or more overbased magnesium-containing detergents may be selected from an overbased magnesium sulfonate detergent, an overbased magnesium phenate detergent, an overbased magnesium salicylate detergent and mixtures thereof. In each of the foregoing embodiments, the one or more overbased magnesium-containing detergents may be an overbased magnesium sulfonate detergent.

In each of the foregoing embodiments, the amount of the one or more magnesium-containing detergents may be not more than 5 wt. % based on the total weight of the lubricating oil composition. In each of the foregoing embodiments, the amount of the one or more magnesium-containing detergents may be not more than 4.0 wt. % based on the total weight of the lubricating oil composition. In each of the foregoing embodiments, the amount of the one or more magnesium-containing detergents may be 0.1 wt. % to not more than 1.5 wt. % based on the total weight of the lubricating oil composition.

In each of the foregoing embodiments, the total magnesium provided to the lubricating oil composition by the overbased magnesium detergent may be from 100 ppm to 1500 ppm, by weight, based on the total weight of the lubricating oil composition or from 150 ppm to 2000 ppm or from 300 ppm to 1500 ppm, based on the total weight of the lubricating oil composition.

In each of the foregoing embodiments, the amount of overbased calcium sulfonate and the amount of overbased calcium phenate may combine to make up not more than 2.0 wt. % of the total weight of the lubricating oil composition. In each of the foregoing embodiments, the amount of overbased calcium sulfonate and the amount of overbased calcium phenate may combine to make up 0.01 wt. % to not more than 7.9 wt. % of the total weight of the lubricating oil composition. In each of the foregoing embodiments, the amount of overbased calcium sulfonate and the amount of overbased calcium phenate may combine to make up 0.01 wt. % to not more than 3.0 wt. % of the total weight of the lubricating oil composition. In each of the foregoing embodiments, the amount of overbased calcium sulfonate and the amount of overbased calcium phenate may combine to make up 0.15 wt. % to not more than 1.5 wt. % of the total weight of the lubricating oil composition.

In each of the foregoing embodiments, the lubricating oil composition may have a total base number of greater than 7.0 mg KOH/g of the lubricating oil composition, measured by the method of ASTM D-2896. In each of the foregoing embodiments, the lubricating oil composition may have a total base number greater than 7.25 mg KOH/g of the lubricating oil composition, as measured by the method of ASTM D-2896. In each of the foregoing embodiments, the total base number of the lubricating oil composition may be greater than 7.5 to 12.0 mg KOH/g of the lubricating oil composition, as measured by the method of ASTM D-2896. In each of the foregoing embodiments, the total base number of the lubricating oil composition may be 7.75 to 10.0 mg KOH/g of the lubricating oil composition, as measured by the method of ASTM D-2896.

In each of the foregoing embodiments, the ratio of calcium in ppm of the lubricant composition to total base number of the lubricant composition may be less than 170. In each of the foregoing embodiments, this ratio may be 50 to 165. In each of the foregoing embodiments, this ratio may be 100 to 150.

In each of the foregoing embodiments, the ratio of magnesium in ppm to total soap content in wt. %, based on a total weight of the lubricating oil composition, may be greater than 700 to 2500. In each of the foregoing embodiments, this may be 750 to 2000. In each of the foregoing embodiments, this ratio may be 850 to 1800.

In each of the foregoing embodiments, the amount of boron in the lubricating oil composition may be up to 300 ppm, based on the total weight of the lubricating composition. In each of the foregoing embodiments, the amount of boron in the lubricating oil composition may be up to 200 ppm, or up to 100 ppm, based on the total weight of the lubricating composition. In each of the foregoing embodiments, the amount of boron in the lubricating oil composition may be from 0.001 ppm up to 50 ppm by weight.

In each of the foregoing embodiments, the total TBN contribution of all detergents to the lubricating oil composition may be greater than 5 mg KOH/g of the lubricating oil composition, or greater than 5.0 to 10.0 mg KOH/g of the lubricating oil composition.

In each of the foregoing embodiments, the amount of molybdenum in the lubricating oil composition may be less than 330 ppm by weight. In each of the foregoing embodiments, the amount of molybdenum in the lubricating oil composition may be from 1 to 200 ppm by weight, based on the total weight of the lubricating oil composition. In each of the foregoing embodiments, the amount of molybdenum in the lubricating oil composition may be from 10 to 150 ppm by weight.

In each of the foregoing embodiments, the lubricating oil composition may include one or more components selected from the group consisting of friction modifiers, antiwear agents, dispersants, antioxidants, and viscosity index improvers.

In each of the foregoing embodiments of the method described herein, the engine, in operation may generate a brake mean effective pressure level of greater than 1,500 kPa (BMEP) at an engine speed of less than 3000 rotations per minute (rpm) or a BMEP of 1,800 kPa at an engine speed of 2000 rpm.

In each of the foregoing embodiments, the lubricating oil composition may pass the Ball Rust Test according to ASTM D6557.

In each of the foregoing embodiments, the total calcium provided to the lubricating oil composition by the one or more overbased detergents may be from 800 ppm to 2400 ppm, by weight, based on the total weight of the lubricating oil composition. In each of the foregoing embodiments, the total calcium provided to the lubricating oil composition by the one or more overbased detergents may be from 850 ppm to 2000 ppm, by weight, based on the total weight of the lubricating oil composition. In each of the foregoing embodiments, the total calcium provided to the lubricating oil composition by the one or more overbased detergents may be from 1000 ppm to 1850 ppm, by weight, based on the total weight of the lubricating oil composition. In each of the foregoing embodiments, the total amount of calcium in the lubricating oil composition may be less than about 1800 ppm, or less than about 1670 ppm, or from about 200 ppm to about 1650 ppm, or from about 500 ppm to about 1625 ppm.

In each of the foregoing embodiments, the lubricating oil composition may have a total wt. % of soap from all detergents in the lubricating oil composition of greater than about 0.01 wt. %, or greater than about 0.4 wt. %, or 0.05 wt. % to 5.0 wt. %, or 0.1 wt. % to 2.0 wt. %, or 0.2 wt. % to 1.5 wt. %.

In each of the foregoing embodiments, the lubricating oil composition may have a total TBN contribution of all detergents to the lubricating oil composition of greater than 4.5 mg KOH/g of the lubricating oil composition, or greater than 5.0 to 12.0 mg KOH/g of the lubricating oil composition or 5.2 to 10.0 mg KOH/g of the lubricating oil composition, or greater than 5.2 to 9.5 mg KOH/g of the lubricating oil composition.

In each of the foregoing embodiments, the one or more overbased calcium phenate detergent(s) may be present in an amount to provide from 100 ppm to less than 910 ppm calcium to the lubricating oil composition, or from 200 ppm to 850 ppm calcium or 400 ppm to 800 ppm calcium to the lubricating oil composition.

In each of the foregoing embodiments, the one or more overbased calcium sulfonate detergent(s) may be present in an amount to provide less than 1300 ppm calcium to the lubricating oil composition, or from 200 ppm to 1200 ppm calcium or 400 ppm to 900 ppm calcium to the lubricating oil composition.

In each of the foregoing embodiments, the one or more overbased magnesium sulfonate detergent(s) may be present in an amount to provide less than 1500 ppm magnesium to the lubricating oil composition, or greater than 400 ppm to 1300 ppm magnesium, or 500 ppm to 1250 ppm magnesium to the lubricating oil composition.

In each of the foregoing embodiments, the lubricating oil composition may comprise not more than 10 wt. % of a Group IV base oil, a Group V base oil, or a combination thereof. In each of the foregoing embodiments, the lubricating oil compositions may comprise less than 5 wt. % of a Group V base oil. In each of the foregoing embodiments, the lubricating oil composition may comprise greater than 50 wt. % of a Group II base oil, a Group III base oil or a combination thereof, or greater than 70 wt. % or greater than 75 wt. % or greater than 80 wt. % or greater than 85 wt. % or greater than 90 wt. % of a Group II base oil, a Group III base oil or a combination thereof.

In each of the foregoing embodiments, the overbased calcium-containing detergents may optionally exclude overbased calcium salicylate detergents.

In each of the foregoing embodiments, the lubricating oil composition may not contain any Group IV base oils.

In each of the foregoing embodiments, the lubricating oil composition may not contain any Group V base oils.

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising greater than 50 wt. % of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating oil composition excluding the greater than 50 wt. % of base oil stock mixture. The additive package may or may not include the viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, and/or phenols. In the present disclosure, the overbased calcium phenate detergent has a TBN of greater than 170 mg KOH/g, and the overbased calcium sulfonate detergent has a TBN of greater than 225 mg KOH/g.

In some instances, "overbased" may be abbreviated "OB" and in some instances, "low-based/neutral" may be abbreviated "LB/N."

The term "total metal" refers to the total metal, metalloid or transition metal in the lubricating oil composition including the metal contributed by the detergent component(s) of the lubricating oil composition.

As used herein, the term "hydrocarbyl substituent" or "hydrocarbyl group" or "alkyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(a) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic moiety);

(b) substituted hydrocarbon substituents, that is, substituents containing non-hydrocarbon groups which, in the context of this disclosure, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); and (c) hetero substituents, that is, substituents which, while having a predominantly hydrocarbon character, in the context of this disclosure, contain other than carbon in a ring or chain otherwise composed of carbon atoms. Heteroatoms may include sulfur, oxygen, and nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents to the weight of the entire composition. Also, the term "ppm", unless expressly stated otherwise, means parts per million weight (ppmw), based on a total weight of the lubricating oil composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g composition as measured by the method of ASTM D-2896. Herein the total base number can be used in at least three separate instances. First, each individual base can have a total base number, such as an overbased calcium sulfonate detergent having a TBN of 300 mg KOH/g of detergent. Second, there is a total base number which is a contribution from all detergents to the lubricating oil composition in mg KOH/g of the lubricating oil composition. Third, there is a total base number of the lubricating oil composition in mg KOH/g of the lubricating oil composition.

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

Lubricants, combinations of components, or individual components of the present description may be suitable for use in various types of internal combustion engines. Suitable engine types may include, but are not limited to heavy duty diesel, passenger car, light duty diesel, medium speed diesel, marine engines, or motorcycle engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression ignited engine. A diesel engine may be a compression ignited engine with a spark-ignition assist. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines.

The internal combustion engine may contain components of one or more of an aluminum-alloy, lead, tin, copper, cast iron, magnesium, ceramics, stainless steel, composites, and/or mixtures thereof. The components may be coated, for example, with a diamond-like carbon coating, a lubricated coating, a phosphorus-containing coating, molybdenum-containing coating, a graphite coating, a nano-particle-containing coating, and/or mixtures thereof. The aluminum-alloy may include aluminum silicates, aluminum oxides, or other ceramic materials. In one embodiment the aluminum-alloy is an aluminum-silicate surface. As used herein, the term "aluminum alloy" is intended to be synonymous with "aluminum composite" and to describe a component or surface comprising aluminum and another component intermixed or reacted on a microscopic or nearly microscopic level, regardless of the detailed structure thereof. This would include any conventional alloys with metals other than aluminum as well as composite or alloy-like structures with non-metallic elements or compounds such with ceramic-like materials.

The lubricating oil composition for an internal combustion engine may be suitable for any engine irrespective of the sulfur, phosphorus, or sulfated ash (ASTM D-874) content. The sulfur content of the lubricating oil may be about 1 wt. % or less, or about 0.8 wt. % or less, or about 0.5 wt. % or less, or about 0.4 wt. % or less. In one embodiment the sulfur content may be in the range of about 0.001 wt. % to about 0.5 wt. %, or about 0.01 wt. % to about 0.4 wt. %. The phosphorus content may be about 0.25 wt. % or less, or about 0.15 wt. % or less, or about 0.12 wt. % or less, or about 0.1 wt. % or less. In one embodiment the phosphorus content may be about 50 ppm to about 1300 ppm, or about 325 ppm to about 1000 ppm. The total sulfated ash content may be about 2 wt. % or less, or about 1.5 wt. % or less, or about 1.2 wt. % or less. In one embodiment the sulfated ash content may be about 0.05 wt. % to about 2.0 wt. %, or about 0.1 wt. % or about 0.2 wt. % to about 1.5 wt. %. In another embodiment, the sulfur content may be about 0.4 wt. % or less, the phosphorus content may be about 0.1 wt. % or less, and the sulfated ash may be about 1.25 wt. % or less. In yet another embodiment the sulfur content may be about 0.4 wt. % or less, the phosphorus content may be about 0.95 wt. % or less, and the sulfated ash may be about 1.2 wt. % or less. ASTM D4951 is a test method which covers eight elements and can provide elemental composition data. ASTM D5185 can be used to determine 22 elements in used and unused lubricating oils and base oils, and can provide screening of used oils for indications of wear.

In some embodiments the lubricating oil composition is an engine oil, wherein the lubricating oil composition may have (i) a sulfur content of about 0.5 wt. % or less, (ii) a phosphorus content of about 0.1 wt. % or less, and (iii) a sulfated ash content of about 1.4 wt. % or less.

In some embodiments, the lubricating oil composition may be suitable for use with engines powered by low sulfur fuels, such as fuels containing about 1 to about 5% sulfur. Highway vehicle fuels contain about 15 ppm sulfur (or about 0.0015% sulfur). The lubricating oil composition may be suitable for use with boosted internal combustion engines including turbocharged or supercharged internal combustion engines.

Further, lubricating oils of the present description may be suitable to meet one or more industry specification requirements such as ILSAC GF-3, GF-4, GF-5, GF-6, PC-11, CI-4, CJ-4, CK-4, FA-4, ACEA A1/B1, A2/B2, A3/B3, A3/B4, A5/B5, C1, C2, C3, C4, C5, E4/E6/E7/E9, Euro 5/6, Jaso DL-1, Low SAPS, Mid SAPS, or original equipment manufacturer specifications such as Dexos1®, Dexos2®, MB-Approval 229.51/229.31 and MB-Approval 229.71, VW 502.00, 503.00/503.01, 504.00, 505.00, 506.00/506.01, 507.00, 508.00, 509.00, BMW Longlife-04, Porsche C30, Peugeot Citroën Automobiles B71 2290, B71 2296, B71 2297, B71 2300, B71 2302, B71 2312, B71 2007, B71 2008, Ford WSS-M2C153-H, WSS-M2C930-A, WSS-M2C945-A, WSS-M2C913A, WSS-M2C913-B, WSS-M2C913-C, GM 6094-M, Chrysler MS-6395, or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

Other hardware may not be suitable for use with the disclosed lubricant. A "functional fluid" is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, some gear oils, power steering fluids, fluids used in wind turbines, compressors, some industrial fluids, and fluids related to power train components. It should be noted that within each of these fluids such as, for example, automatic transmission fluids, there are a variety of different types of fluids due to the various transmissions having different designs which have led to the need for fluids of markedly different functional characteristics. This is contrasted by the term "lubricating fluid" which is not used to generate or transfer power.

With respect to tractor hydraulic fluids, for example, these fluids are all-purpose products used for all lubricant applications in a tractor except for lubricating the engine. These lubricating applications may include lubrication of gearboxes, power take-off and clutch(es), rear axles, reduction gears, wet brakes, and hydraulic accessories.

When a functional fluid is an automatic transmission fluid, the automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail. This is not a function of an engine oil.

Tractor fluids, and for example Super Tractor Universal Oils (STUOs) or Universal Tractor Transmission Oils (UTTOs), may combine the performance of engine oils with transmissions, differentials, final-drive planetary gears, wet-brakes, and hydraulic performance. While many of the additives used to formulate a UTTO or a STUO fluid are similar in functionality, they may have deleterious effect if not incorporated properly. For example, some anti-wear and extreme pressure additives used in engine oils can be extremely corrosive to the copper components in hydraulic pumps. Detergents and dispersants used for gasoline or diesel engine performance may be detrimental to wet brake performance. Friction modifiers specific to quiet wet brake noise, may lack the thermal stability required for engine oil performance. Each of these fluids, whether functional, tractor, or lubricating, are designed to meet specific and stringent manufacturer requirements.

The present disclosure provides novel lubricating oil blends formulated for use as automotive crankcase lubricants. Embodiments of the present disclosure may provide lubricating oils suitable for crankcase applications and having improvements in the following characteristics: air entrainment, alcohol fuel compatibility, antioxidancy, anti-wear performance, biofuel compatibility, foam reducing properties, friction reduction, fuel economy, pre-ignition prevention, rust inhibition, sludge and/or soot dispersability, piston cleanliness, deposit formation, and water tolerance.

Engine oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil (or a mixture of both). The fully formulated engine oil may exhibit improved performance properties, based on the additives added and their respective proportions.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Various embodiments of the disclosure provide a lubricating oil composition and methods that may be used for reducing a number of low-speed pre-ignition events (LSPI) in a boosted internal combustion engine. In particular, boosted internal combustion engines of the present disclosure include turbocharged and supercharged internal combustion engines. The boosted internal combustion engines include spark-ignited, direct injection or spark-ignited port fuel injection engines. The spark-ignited internal combustion engines may be gasoline engines.

The composition of the invention includes a lubricating oil composition containing a base oil of lubricating viscosity and a particular additive composition. The methods of the present disclosure employ the lubricating oil composition containing the additive composition. As described in more detail below the lubricating oil composition may be surprisingly effective for use in reducing a number of low-speed pre-ignition events in a boosted internal combustion engine lubricated with the lubricating oil composition. In one embodiment, the disclosure provides a lubricating oil composition and method of operating a boosted internal combustion engine. The lubricating oil composition includes greater than 50 wt. % of a base oil of lubricating viscosity, based on a total weight of the lubricating oil composition, one or more overbased calcium sulfonate detergents having a total base number of greater than 225 mg KOH/g, measured by the method of ASTM D-2896, one or more overbased calcium phenate detergents having a total base number of greater than 170 mg KOH/g, measured by the method of ASTM D-2896 and one or more overbased magnesium-containing detergents. A ratio of the amount of calcium in ppm to the total base number of the lubricant composition measured by the method of ASTM D-2896 is less than 170. A ratio of magnesium in ppm to total soap content in wt. %, based on a total weight of the lubricating oil composition, is greater than 700. An amount of boron in the lubricating oil composition is less than 300 ppm by weight; an amount of molybdenum in the lubricating oil composition is less than 330 ppm by weight. The lubricating oil composition may be effective to reduce a number of low-speed pre-ignition events in the boosted internal combustion engine lubricated with the lubricating oil composition relative to a number of low-speed pre-ignition events in the boosted internal combustion engine for a reference oil C-1.

In another embodiment, the disclosure provides a method for reducing low-speed pre-ignition events in a boosted internal combustion engine. The method includes a step of lubricating the boosted internal combustion engine with a lubricating oil composition including greater than 50 wt. % of a base oil of lubricating viscosity, based on a total weight of the lubricating oil composition, one or more overbased calcium sulfonate detergents having a total base number of greater than 225 mg KOH/g, measured by the method of ASTM D-2896, one or more overbased calcium phenate detergents having a total base number of greater than 170 mg KOH/g, measured by the method of ASTM D-2896 and one or more overbased magnesium-containing detergents. In this method, a ratio of the amount of calcium in ppm to total base number of the lubricating oil composition measured by the method of ASTM D-2896 is less than 170, a ratio of magnesium in ppm to total soap content in wt. %, based on a total weight of the lubricating oil composition, is greater than 700, an amount of boron in the lubricating oil composition is less than 300 ppm by weight, an amount of molybdenum in the lubricating oil composition is less than 330 ppm by weight. The boosted internal combustion engine is operated while lubricated with the lubricating oil composition whereby a number of low-speed pre-ignition events in the engine lubricated with the lubricating oil composition may be reduced relative to a number of low-speed pre-ignition events in the boosted internal combustion engine operated while lubricated with a reference oil C-1.

In each of the foregoing embodiments, the lubricating oil composition may have a total base number of greater than 7.0 mg KOH/g of the lubricating oil composition, measured by the method of ASTM D-2896. In each of the foregoing embodiments, the total base number of the lubricating oil composition can be greater than 7.25 mg KOH/g of the lubricating oil composition or it can be greater than 7.25 to 11.0 mg KOH/g of the lubricating oil composition, or it can be 7.75 to 10.0 mg KOH/g of the lubricating oil composition, all as measured by the method of ASTM D-2896.

In each of the foregoing embodiments, the ratio of calcium in ppm of the lubricant composition to total base number of the lubricant composition can be less than 170, or this ratio can be 50 to 165 or this ratio can be 100 to 150.

In each of the foregoing embodiments, the ratio of magnesium in ppm to the total soap content in wt. %, based on a total weight of the lubricating oil composition, may be 700 to 2500, or 750 to 2000, or 850 to 1800.

In each of the foregoing embodiments, the amount of boron in the lubricating oil composition may be less than 300 ppm, or less than 200 ppm, or less than 100 ppm, or the amount of boron in the lubricating oil composition may be from 0.001 up to 50 ppmt.

In each of the foregoing embodiments, the amount of molybdenum in the lubricating oil composition may be less than 300 ppm or from 1 to 200 ppm, or from 10 to 150 ppm.

In each of the foregoing embodiments of the disclosure, the amount of sodium in the lubricating composition may be limited to not more than 150 ppm of sodium, by weight, based on a total weight of the lubricating oil composition. or not more than 50 ppm of sodium, by weight, based on a total weight of the lubricating oil composition.

In some embodiments, the combustion chamber or cylinder walls of a spark-ignited direct injection engine or spark-ignited port fuel injection internal combustion engine provided with a turbocharger or a supercharger is lubricated with the lubricating oil composition during engine operation whereby the number of low-speed pre-ignition events in the engine lubricated with the lubricating oil composition may be reduced.

Optionally, the methods of the present invention may include a step of measuring the number of low-speed pre-ignition events of the internal combustion engine lubricated with the lubricating oil composition. In such methods, the reduction of the number of LSPI events may be a greater than 50% reduction, or a greater than 85% reduction, or a 90% or greater reduction, or a 93% or greater reduction, or a 95% or greater reduction in the LSPI ratio, as compared to reference oil C-1. The number of LSPI events may be a number of LSPI counts during 25,000 engine cycles, wherein the engine is operated at 2000 revolutions per minute with a brake mean effective pressure of 1,800 kPa.

As described in more detail below, embodiments of the disclosure may provide a significant and unexpected improvement in reducing LSPI events while maintaining a relatively high calcium detergent amount in the lubricating oil composition. Embodiments of the disclosure may also pass the Ball Rust Test in combination with reducing LSPI events.

Detergents

The lubricating oil composition comprises one or more overbased calcium sulfonate, overbased calcium phenate and overbased magnesium-containing detergents, and optionally includes other overbased or low-based/neutral detergents. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein. The detergent substrate may be salted with an alkali or alkaline earth metal such as, but not limited to, calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or di-alkylarylsulfonic acids with the aryl group being benzyl, tolyl, and xylyl.

Examples of suitable additional detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergents are well known in the art and may be alkali or alkaline earth metal overbased detergent. Such detergents may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent may have a TBN of greater 170 mg KOH/gram, or as further examples, a TBN of about 250 mg KOH/gram or greater, or a TBN of about 300 mg KOH/gram or greater, or a TBN of about 350 mg KOH/gram or greater, or a TBN of about 375 mg KOH/gram or greater, or a TBN of about 400 mg KOH/gram or greater, as measured by the method of ASTM D-2896.

In any of the foregoing embodiments, the one or more overbased sulfonate detergents has a total base number of at least 225 mg KOH/g. In each of the foregoing embodiments, the one or more overbased sulfonate detergents may have a total base number of at least 250 mg KOH/g. In each of the foregoing embodiments, the one or more overbased sulfonate detergents may have a total base number of 260-450 mg KOH/g, as measured by the method of ASTM D-2896.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased detergent may have a metal to substrate ratio of from 1.1:1, or from 2:1, or from 4:1, or from 5:1, or from 7:1, or from 10:1.

In some embodiments, a detergent is an anticorrosive agent and is effective at reducing or preventing rust in an engine.

The total amount of detergent may be up to 15 wt. %, or about up to 8 wt. %, or up to about 4 wt. %, 0.1 wt. % to 15.0 wt. %, or 0.2 wt. % to 8.0 wt. %, or greater than about 1 wt. % to about 3.5 wt. %, based on a total weight of the lubricating oil composition.

The total amount of detergent may be present in an amount to provide from about 1100 to about 3500 ppm metal to the lubricating oil composition. In other embodiments, the detergent may provide from about 1100 to about 3000 ppm of metal, or about 1150 to about 2500 ppm of metal, or about 1200 to about 2400 ppm of metal to the lubricating oil composition.

The total magnesium provided to the lubricating oil composition by the overbased magnesium detergent can be from 100 ppm to 1500 ppm, by weight, based on the total weight of the lubricating oil composition or from 150 ppm to 2000 ppm or from 300 ppm to 1500 ppm, based on the total weight of the lubricating oil composition.

The lubricating oil compositions of the present disclosure include at least one overbased calcium sulfonate detergent having a TBN of greater than 225 mg KOH/gram at least one overbased calcium phenate detergent having a TBN of greater than 170 mg KOH/gram, and at least one overbased magnesium-containing detergent, wherein the TBN is measured by the method of ASTM D-2896. The present disclosure also includes methods of using such lubricating oil compositions in a method or lubricating an engine by lubricating the engine with the lubricating oil composition and operating the engine.

The lubricating oil composition of the disclosure may have a total amount of calcium from the overbased detergents that ranges from 800 ppm to 2400 ppm based on a total weight of the lubricating oil composition, or from 850 ppm to less than 2000 ppm based on a total weight of the lubricating oil composition, or from 1000 ppm to 1850 ppm based on a total weight of the lubricating oil composition.

The overbased detergent may be an overbased magnesium-containing detergent. The overbased magnesium-containing detergent may be selected from an overbased magnesium sulfonate detergent, an overbased magnesium phenate detergent, and an overbased magnesium salicylate detergent. In certain embodiments, the overbased magnesium-containing detergent comprises an overbased magnesium sulfonate detergent. In certain embodiments, the overbased detergent is one or more magnesium-containing detergents, preferably the overbased detergent is a magnesium sulfonate detergent.

In each of the foregoing embodiments, the lubricating oil composition of the disclosure may include a low-based/neutral detergent which has a TBN of up to 170 mg KOH/g, or up to 150 mg KOH/g, as measured by the method of ASTM D-2896. The low-based/neutral detergent may include a calcium-containing detergent. The low-based neutral calcium-containing detergent may be selected from a calcium sulfonate detergent, a calcium phenate detergent and a calcium salicylate detergent. In some embodiments, the low-based/neutral detergent is a calcium-containing detergent or a mixture of calcium-containing detergents. In some embodiments, the low-based/neutral detergent is a calcium sulfonate detergent or a calcium phenate detergent.

In each of the foregoing embodiments, the lubricating oil composition of the disclosure may include the low-based/neutral detergent in an amount of at least 2.5 wt. % of the total detergent in the lubricating oil composition. In some embodiments, at least 4 wt. %, or at least 6 wt. %, or at least 8 wt. %, or at least 10 wt. % or at least 12 wt. % or at least 20 wt. % of the total detergent in the lubricating oil composition is a low-based/neutral detergent which may optionally be a low-based/neutral calcium-containing detergent.

In certain embodiments, the one or more low-based/neutral calcium-containing detergents may provide from about 50 to about 1000 ppm calcium to the lubricating oil composition based on a total weight of the lubricating oil composition. In some embodiments, the one or more low-based/neutral calcium-containing detergents may provide from 75 to less than 800 ppm, or from 100 to 600 ppm, or from 125 to 500 ppm calcium to the lubricating oil composition based on a total weight of the lubricating oil composition.

In some embodiments, the lubricating oil composition may have a ratio of total ppm of calcium and magnesium to TBN of the lubricating oil composition ranging from greater than 20 to about 400. In some embodiments the ratio of total ppm of calcium and magnesium to TBN of the lubricating oil composition may range from greater than 150 to less than 260 or from 190 to 250.

In each of the foregoing embodiments, the ratio of calcium in ppm of the lubricant composition to total base number of the lubricant composition can be less than 170, or this ratio can be 50 to 165 or this ratio can be 100 to 150.

In each of the foregoing embodiments, the ratio of magnesium in ppm to the total soap content in wt. %, based on a total weight of the lubricating oil composition may be 700 to 2500, or 750 to 2000, or 850 to 1800.

In some embodiments the ratio of the ppm of calcium, by weight, provided to the lubricating oil composition by the one or more overbased calcium-containing detergents to the ppm of magnesium, by weight, provided to the lubricating oil composition by the one or more overbased magnesium-containing detergents, may be at least 0.01, or from about 0.01 to about 100, or from about 0.1 to about 10, or from about 0.5 to about 5.

The overbased calcium-containing detergent may optionally exclude overbased calcium salicylate detergents.

Base Oil

The base oil used in the lubricating oil compositions herein may be selected from any of the base oils in Groups I-V as specified in the American Petroleum Institute (API) Base Oil Interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |

TABLE 1-continued

| Base oil Category | Sulfur (%) | Saturates (%) | Viscosity Index |
|---|---|---|---|
| Group V | All others not included in Groups I, II, III, or IV | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry.

The base oil used in the disclosed lubricating oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene/isobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The greater than 50 wt. % of base oil included in a lubricating composition may be selected from the group consisting of Group I, Group II, a Group III, a Group IV, a Group V, and a combination of two or more of the foregoing, and wherein the greater than 50 wt. % of base oil is other than base oils that arise from provision of additive components or viscosity index improvers in the composition. In another embodiment, the greater than 50 wt. % of base oil included in a lubricating composition may be selected from the group consisting of Group II, a Group III, a Group IV, a Group V, and a combination of two or more of the foregoing. Also, the base oil may be selected from a Group II-Group V base oil or a mixture of any two or more thereof. The greater than 50 wt. % of base oil, based on the total weight of the lubricating oil composition, may be other than diluent oils that arise from provision of additive components or viscosity index improvers to the composition.

The amount of the oil of lubricating viscosity present may be the balance remaining after subtracting from 100 wt. % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt. %, greater than about 60 wt. %, greater than about 70 wt. %, greater than about 80 wt. %, greater than about 85 wt. %, or greater than about 90 wt. %.

The lubricating oil composition may comprise not more than 10 wt. % of a Group IV base oil, a Group V base oil, or a combination thereof. In each of the foregoing embodiments, the lubricating oil composition may comprise less than 5 wt. % of a Group V base oil. The lubricating oil composition of some embodiments does not contain any Group IV base oils and/or does not contain any Group V base oils. The lubricating oil composition may comprise greater than 50 wt. % of a Group II base oil, a Group III base oil or a combination thereof.

Each of the foregoing embodiments of the lubricating oil composition may also include one or more optional components selected from the various additives set forth below.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., IRGANOX™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include ETHANOX™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the total weight of the lubricating oil composition. In an embodiment, the antioxidant may be a mixture of about 0.3 to about 1.5% diarylamine and about 0.4 to about 2.5% high molecular weight phenol, by weight, based upon the total weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges about 0.0 wt. % to about 5.0 wt. %, or about 0.1 wt. % to about 3.0 wt. %, or about 0.2 wt. % to about 2.75 wt. % of the lubricating oil composition.

Antiwear Agents

The lubricating oil compositions herein also may optionally contain one or more antiwear agents. Examples of suitable antiwear agents include, but are not limited to, a metal thiophosphate; a metal dialkyldithiophosphate; a phosphoric acid ester or salt thereof a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0.0 wt. % to about 10 wt. %, or about 0.0 wt. % to about 5.0 wt. %, or about 0.05 wt. % to about 5.0 wt. %, or about 0.1 wt. % to about 3 wt. %, or less than 2.0 wt. % of the lubricating oil composition.

An antiwear compound may be a zinc dihydrocarbyl dithiophosphate (ZDDP) having a P:Zn ratio of from about 1:0.8 to about 1:1.7. The dihydrocarbyl groups of the ZDDP may be formed from a mixture of C3 and C6 alcohols.

Boron-Containing Compounds

The lubricating oil compositions herein may optionally contain one or more boron-containing compounds. The amount of boron in the lubricating oil composition is less than 300 ppm by weight, based on the total weight of the lubricating oil composition, or less than 750 ppm by weight, based on the total weight of the lubricating oil composition, or less than 50 ppm by weight, based on the total weight of the lubricating oil composition.

Examples of boron-containing compounds include borate esters, borated fatty amines, borated epoxides, borated detergents, and borated dispersants, such as borated succinimide dispersants, as disclosed in U.S. Pat. No. 5,883,057.

The one or more boron-containing compounds, if present, can be used in an amount sufficient to provide less than 300 ppm boron to the lubricating oil composition or less than 200 ppm boron to the lubricating oil composition or less than 100 ppm boron to the lubricating oil composition, or less than 50 ppm boron to the lubricating oil composition.

Dispersants

The lubricating oil composition may optionally further comprise one or more dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range about 350 to about 50,000, or to about 5,000, or to about 3,000. Succinimide dispersants and their preparation are disclosed, for instance in U.S. Pat. No. 7,897,696 or 4,234,435. The polyolefin may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

In an embodiment the present disclosure further comprises at least one polyisobutylene succinimide dispersant derived from polyisobutylene with number average molecular weight in the range about 350 to about 50,000, or to about 5000, or to about 3000. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000 is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights.

In one embodiment, the dispersant may be derived from a polyalphaolefin (PAO) succinic anhydride.

In one embodiment, the dispersant may be derived from olefin maleic anhydride copolymer. As an example, the dispersant may be described as a poly-PIBSA.

In an embodiment, the dispersant may be derived from an anhydride which is grafted to an ethylene-propylene copolymer.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 disclose suitable dispersants and post-treatments.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, Such treatments include, treatment with:

- Inorganic phosphorous acids or anhydrates (e.g., U.S. Pat. Nos. 3,403,102 and 4,648,980);
- Organic phosphorous compounds (e.g., U.S. Pat. No. 3,502,677);
- Phosphorous pentasulfides;
- Boron compounds as already noted above (e.g., U.S. Pat. Nos. 3,178,663 and 4,652,387);
- Carboxylic acid, polycarboxylic acids, anhydrides and/or acid halides (e.g., U.S. Pat. Nos. 3,708,522 and 4,948,386);
- Epoxides, polyepoxides or thioexpoxides (e.g., U.S. Pat. Nos. 3,859,318 and 5,026,495);
- Aldehyde or ketone (e.g., U.S. Pat. No. 3,458,530);
- Carbon disulfide (e.g., U.S. Pat. No. 3,256,185);
- Glycidol (e.g., U.S. Pat. No. 4,617,137);
- Urea, thourea or guanidine (e.g., U.S. Pat. Nos. 3,312,619; 3,865,813; and British Patent GB 1,065,595);
- Organic sulfonic acid (e.g., U.S. Pat. No. 3,189,544 and British Patent GB 2,140,811);
- Alkenyl cyanide (e.g., U.S. Pat. Nos. 3,278,550 and 3,366,569);
- Diketene (e.g., U.S. Pat. No. 3,546,243);
- A diisocyanate (e.g., U.S. Pat. No. 3,573,205);
- Alkane sultone (e.g., U.S. Pat. No. 3,749,695);
- 1,3-Dicarbonyl Compound (e.g., U.S. Pat. No. 4,579,675);
- Sulfate of alkoxylated alcohol or phenol (e.g., U.S. Pat. No. 3,954,639);
- Cyclic lactone (e.g., U.S. Pat. Nos. 4,617,138; 4,645,515; 4,668,246; 4,963,275; and 4,971,711);
- Cyclic carbonate or thiocarbonate linear monocarbonate or polycarbonate, or chloroformate (e.g., U.S. Pat. Nos. 4,612,132; 4,647,390; 4,648,886; 4,670,170);
- Nitrogen-containing carboxylic acid (e.g., U.S. Pat. No. 4,971,598 and British Patent GB 2,140,811);
- Hydroxy-protected chlorodicarbonyloxy compound (e.g., U.S. Pat. No. 4,614,522);
- Lactam, thiolactam, thiolactone or ditholactone (e.g., U.S. Pat. Nos. 4,614,603 and 4,666,460);
- Cyclic carbonate or thiocarbonate, linear monocarbonate or polycarbonate, or chloroformate (e.g., U.S. Pat. Nos. 4,612,132; 4,647,390; 4,646,886; and 4,670,170);
- Nitrogen-containing carboxylic acid (e.g., U.S. Pat. No. 4,971,598 and British Patent GB 2,440,811);
- Hydroxy-protected chlorodicarbonyloxy compound (e.g., U.S. Pat. No. 4,614,522);
- Lactam, thiolactam, thiolactone or dithiolactone (e.g., U.S. Pat. Nos. 4,614,603, and 4,666,460);
- Cyclic carbamate, cyclic thiocarbamate or cyclic dithiocarbamate (e.g., U.S. Pat. Nos. 4,663,062 and 4,666,459);
- Hydroxyaliphatic carboxylic acid (e.g., U.S. Pat. Nos. 4,482,464; 4,521,318; 4,713,189);
- Oxidizing agent (e.g., U.S. Pat. No. 4,379,064);
- Combination of phosphorus pentasulfide and a polyalkylene polyamine (e.g., U.S. Pat. No. 3,185,647);
- Combination of carboxylic acid or an aldehyde or ketone and sulfur or sulfur chloride (e.g., U.S. Pat. Nos. 3,390,086; 3,470,098);
- Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307);
- Combination of an aldehyde and an O-diester of dithiophosphoric acid (e.g., U.S. Pat. No. 3,865,740);
- Combination of a hydroxyaliphatic carboxylic acid and a boric acid (e.g., U.S. Pat. No. 4,554,086);
- Combination of a hydroxyaliphatic carboxylic acid, then formaldehyde and a phenol (e.g., U.S. Pat. No. 4,636,322);
- Combination of a hydroxyaliphatic carboxylic acid and then an aliphatic dicarboxylic acid (e.g., U.S. Pat. No. 4,663,064);
- Combination of formaldehyde and a phenol and then glycolic acid (e.g., U.S. Pat. No. 4,699,724);
- Combination of a hydroxyaliphatic carboxylic acid or oxalic acid and then a diisocyanate (e.g. U.S. Pat. No. 4,713,191);
- Combination of inorganic acid or anhydride of phosphorus or a partial or total sulfur analog thereof and a boron compound (e.g., U.S. Pat. No. 4,857,214);
- Combination of an organic diacid then an unsaturated fatty acid and then a nitrosoaromatic amine optionally followed by a boron compound and then a glycolating agent (e.g., U.S. Pat. No. 4,973,412);
- Combination of an aldehyde and a triazole (e.g., U.S. Pat. No. 4,963,278);
- Combination of an aldehyde and a triazole then a boron compound (e.g., U.S. Pat. No. 4,981,492);
- Combination of cyclic lactone and a boron compound (e.g., U.S. Pat. Nos. 4,963,275 and 4,971,711).

The TBN of a suitable dispersant may be from about 10 to about 65 on an oil-free basis, which is comparable to about 5 to about 30 TBN if measured on a dispersant sample containing about 50% diluent oil.

The dispersant, if present, can be used in an amount sufficient to provide up to about 20 wt. %, based upon the total weight of the lubricating oil composition. Another amount of the dispersant that can be used may be 0.0 wt. % to about 12.0 wt., or about 0.1 wt. % to about 12 wt. %, or about 2.0 wt. % to about 10.0 wt. %, or about 1.0 wt. % to about 8.5 wt. %, or about 4.0 wt. % to about 8.0 wt. %, based upon the total weight of the lubricating oil composition. In some embodiments, the lubricating oil composition utilizes a mixed dispersant system. A single type or a mixture of two or more types of dispersants in any desired ratio may be used.

Friction Modifiers

The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

A friction modifier may optionally be present in ranges such as about 0.01 wt. % to about 5.0 wt. %, or about 0.01 wt. % to about 3.0 wt. %, or 0.02 wt. % to about 1.5 wt. %, or about 0.1 wt. % to about 1.4 wt. %.

Molybdenum-Containing Component

The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan 822™, Molyvan™ A, Molyvan 2000™ and Molyvan 855™ from R. T. Vanderbilt Co., Ltd., and Sakura-Lube™ S-165, S-200, S-300, S-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and US Patent Publication No. 2002/0038525.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685.

The oil-soluble molybdenum compound may be present in an amount sufficient to provide less than 330 ppm, or about 1 ppm to about 200 ppm, or about 1 ppm to about 150 ppm, or about 5 ppm to about 130 ppm of molybdenum.

Titanium-Containing Compounds

Another class of additives includes oil-soluble titanium compounds. The oil-soluble titanium compounds may function as antiwear agents, friction modifiers, antioxidants, deposit control additives, or more than one of these functions. In an embodiment the oil soluble titanium compound may be a titanium (IV) alkoxide. The titanium alkoxide may be formed from a monohydric alcohol, a polyol, or mixtures thereof. The monohydric alkoxides may have 2 to 16, or 3 to 10 carbon atoms. In an embodiment, the titanium alkoxide may be titanium (IV) isopropoxide. In an embodiment, the titanium alkoxide may be titanium (IV) 2-ethylhexoxide. In an embodiment, the titanium compound may be the alkoxide of a 1,2-diol or polyol. In an embodiment, the 1,2-diol comprises a fatty acid mono-ester of glycerol, such as oleic acid. In an embodiment, the oil soluble titanium compound may be a titanium carboxylate. In an embodiment the titanium (IV) carboxylate may be titanium neodecanoate.

In an embodiment the oil soluble titanium compound may be present in the lubricating oil composition in an amount to provide from zero to about 1500 ppm titanium or about 10 ppm to 500 ppm titanium or about 25 ppm to about 150 ppm.

Transition Metal-Containing Compounds

In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In one embodiment, the oil-soluble compound that may be used in a weight ratio of Ca/M ranging from about 0.8:1 to about 70:1 is a titanium containing compound, wherein M is the total metal in the lubricating oil composition as described above. The titanium-containing compounds may function as antiwear agents, friction modifiers, antioxidants, deposit control additives, or more than one of these functions. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

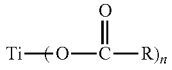

wherein n is an integer selected from 2, 3 and 4, and R is a hydrocarbyl group containing from about 5 to about 24 carbon atoms, or by the formula:

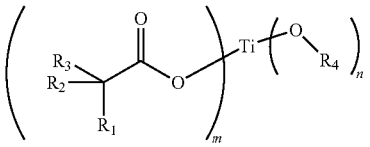

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or by the formula:

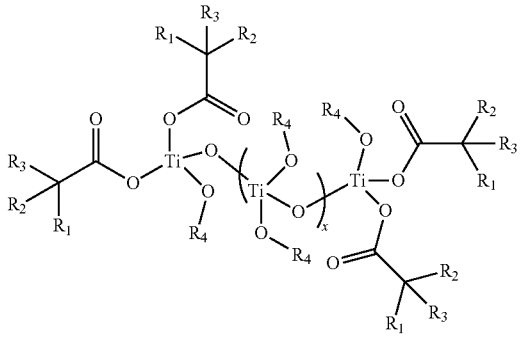

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium or 25 to about 1500 ppm titanium or about 35 ppm to 500 ppm titanium or about 50 ppm to about 300 ppm.

Viscosity Index Improvers

The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in U.S. Pat. No. 8,999,905 B2.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt. % to about 20 wt. %, about 0.1 wt. % to about 15 wt. %, about 0.1 wt. % to about 13 wt. %, or 0.25 wt. % to about 12 wt. %, or about 0.5 wt. % to about 11 wt. %, or about 3.0 wt. % to about 10.5 wt. %, of the lubricating oil composition.

Other Optional Additives

Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt. % to about 5 wt. %, about 0.01 wt. % to about 1.5 wt. %, or about 0.02 wt. % to about 0.4 wt. % based upon the total weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in an amount sufficient to provide about 0 wt. % to about 5 wt. %, about 0.01 wt. % to about 3 wt. %, about 0.1 wt. % to about 2 wt. %, based upon the total weight of the lubricating oil composition.

In general terms, a suitable crankcase lubricant may include additive components in the ranges listed in the following table.

TABLE 2

| Component | Wt. % (Broad) | Wt. % (Typical) |
|---|---|---|
| Dispersant(s) | 0.0-12.0% | 2.0-10.0% |
| Antioxidant(s) | 0.0-5.0 | 0.01-3.0 |
| Metal Detergent(s) | 0.1-15.0 | 0.2-8.0 |
| Ashless TBN booster(s) | 0.0-1.0 | 0.01-0.5 |
| Corrosion Inhibitor(s) | 0.0-5.0 | 0.0-2.0 |
| Metal dihydrocarbyl dithiophosphate(s) | 0.1-6.0 | 0.1-4.0 |
| Ash-free amine phosphate salt(s) | 0.0-3.0 | 0.0-1.5 |
| Antifoaming agent(s) | 0.0-5.0 | 0.001-0.15 |
| Antiwear agent(s) | 0.0-10.0 | 0.0-5.0 |
| Pour point depressant(s) | 0.0-5.0 | 0.01-1.5 |
| Viscosity index improver(s) | 0.0-20.00 | 0.25-11.0 |
| Dispersant viscosity index improver(s) | 0.0-10.0 | 0.0-5.0 |
| Friction modifier(s) | 0.01-5.0 | 0.02-1.5 |
| Base oil(s) | Balance | Balance |
| Total | 100 | 100 |

The percentages of each component above represent the weight percent of each component, based upon the total weight of the lubricating oil composition. The remainder of the lubricating oil composition consists of one or more base oils.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

The present disclosure provides novel lubricating oil blends specifically formulated for use as automotive engine lubricants. Embodiments of the present disclosure may provide lubricating oils suitable for engine applications that provide improvements in one or more of the following characteristics: low-speed pre-ignition events, antioxidancy, antiwear performance, rust inhibition, fuel economy, water tolerance, air entrainment, seal protection, deposit reduction, passing the Ball Rust Test, and foam reducing properties.

Fully formulated lubricants conventionally contain an additive package, referred to herein as a dispersant/inhibitor package or DI package, that will supply the characteristics that are required in the formulations. Suitable DI packages are described for example in U.S. Pat. Nos. 5,204,012 and 6,034,040 for example. Among the types of additives included in the additive package may be dispersants, seal swell agents, antioxidants, foam inhibitors, lubricity agents, rust inhibitors, corrosion inhibitors, demulsifiers, viscosity index improvers, and the like. Several of these components are well known to those skilled in the art and are generally used in conventional amounts with the additives and compositions described herein.

The following examples are illustrative, but not limiting, of the methods and compositions of the present disclosure. Other suitable modifications and adaptations of the variety of conditions and parameters normally encountered in the field, and which are obvious to those skilled in the art, are within the scope of the disclosure.

EXAMPLES

Fully formulated lubricating oil compositions containing conventional additives were made and the number of low-speed pre-ignition events of the lubricating oil compositions were measured. Each of the lubricating oil compositions contained a major amount of greater than 50 wt. % of a base oil, based on the total weight of the lubricating oil composition, a conventional dispersant inhibitor (DI) package plus a viscosity index improver(s), wherein the DI package (less the viscosity index improver) provided about 8 to 16 percent of the lubricating oil composition. The DI package contained conventional amounts of dispersant(s), antiwear additive(s), antifoam agent(s), and antioxidant(s) as set forth in Table 3 below. Specifically, the DI package contained a succinimide dispersant, a borated succinimide dispersant, a molybdenum-containing compound, a friction modifier, one or more antioxidants, and one or more antiwear agents (unless specified otherwise). About 4 to about 10 wt. % of one or more viscosity index improver(s) was included in each tested lubricating oil composition. A base oil was used as a diluent oil for the viscosity index improver(s). The major amount of base oil (about 70 to about 87 wt. %) was a Group III base oil. The components that were varied are specified in the Tables and discussion of the Examples below. All the values listed in Table 3 are stated as weight percent of the component in the lubricating oil composition, based on the total weight of the lubricating oil composition (i.e., active ingredient plus diluent oil, if any), unless specified otherwise.

TABLE 3

DI Package Composition Ranges

| Component | Wt. % |
|---|---|
| Antioxidant(s) | 0.5 to 2.5 |
| Antiwear agent(s), including any metal dihydrocarbyl dithiophosphate | 0.5 to 1.5 |
| Antifoaming agent(s) | 0.001 to 0.01 |
| Detergent(s) | 1.0-3.0 |
| Dispersant (s) | 5.0 to 9.0 |
| Metal-containing friction modifier(s) | 0.03 to 1.5 |
| Metal free friction modifier(s) | 0.0 to 0.5 |
| Pour point depressant(s) | 0.05 to 0.5 |
| Process oil | 0.25 to 1.0 |

Low-speed Pre-Ignition (LSPI) events were measured in a GM 2.0 Liter, 4 cylinder Ecotec turbocharged gasoline direct injection (GDI) engine. One complete LSPI fired engine test consisted of 4 test cycles. Within a single test cycle, two operational stages or segments are repeated in order to generate LSPI events. In stage A, when LSPI is most likely to occur, the engine is operated at about 2000 rpm and about an 1,800 kPa brake mean effective pressure (BMEP). In stage B, when LSPI is not likely to occur, the engine is operated at about 1500 rpm and about s 1,700 kPa BMEP. For each stage, data is collected over 25,000 engine cycles. The structure of a test cycle is as follows: stage A-stage A-stage B-stage B-stage A-stage A. Each stage is separated by an idle period. Because LSPI is statistically significant during stage A, the LSPI event data that was considered in the present examples only included LSPI events generated during stage A operation. Thus, for one complete LSPI fired engine test, data was typically generated over a total of 16 stages and was used to evaluate performance of comparative and inventive oils.

LSPI events were determined by monitoring peak cylinder pressure (PP) and when 2% of the combustible material in the combustion chamber burns (MFB02). The threshold for peak cylinder pressure is calculated for each cylinder and for each stage and is typically 6,500 to 8,500 kPa. The threshold for MFB02 is calculated for each cylinder and for each stage and typically ranges from about 3.0 to about 7.5 Crank Angle Degree (CAD) After Top Dead Center (ATDC). An LSPI event was recorded when both the PP and MFB02 thresholds were exceeded in a single engine cycle. LSPI events can be reported in many ways. In order to remove ambiguity involved with reporting counts per engine cycle, where different fired engine tests can be conducted with a different number of engine cycles, the relative LSPI events of comparative and inventive oils was reported as an "LSPI Ratio". In this way improvement relative to some standard response is clearly demonstrated.

Reference oil C-1 and the oil of comparative example C-2 are capable engine oils. C-1 meets all ILSAC GF-5 performance requirements, including passage of the Ball Rust Test (ASTM D-6557) discussed below.

In the following examples, combinations of an overbased calcium detergent and a magnesium detergent were tested. The LSPI Ratio was reported as a ratio of the LSPI events of comparative test oils C-2 to C-5 and inventive test oils I-1 and I-2 relative to the LSPI events of Reference Oil "C-1". As shown in Table 4 below, C-1 was a lubricating oil composition formulated with a DI package and an overbased calcium detergent in an amount to provide about 2400 ppm Ca to the lubricating oil composition. More detailed formulation information for test oils C-2 to C-5 and inventive test oils I-1 and I-2 is given below.

Considerable improvement in LSPI is recognized when there is greater than n 50% reduction in LSPI events relative to reference oil C-1 (i.e. an LSPI Ratio of less than 0.5). A further improvement is recognized when there is greater than an 85% reduction in LSPI events relative to reference oil C-1 (i.e. an LSPI ratio of less than 0.15). An even further improvement is recognized when there is a 90% or greater reduction in LSPI events relative to reference oil C-1 (i.e. an LSPI Ratio of less than 0.1). An even further improvement is recognized when there is a 93% or greater reduction in LSPI events relative to reference oil C-1 (i.e. an LSPI Ratio of less than 0.07), and an even further improvement is recognized when there a 95% or greater reduction in LSPI events relative to reference oil C-1 (i.e. an LSPI Ratio of less than 0.05). The LSPI Ratio for the C-1 reference oil is thus deemed to be 1.00.

The Ball Rust Test (BRT) is a procedure for evaluating the anti-corrosion ability of fluid lubricants. In accordance with ASTM D6557, a ball bearing is immersed in an oil. Air saturated with acidic contaminants is bubbled through the oil for 18 hours at 49° C. After the 18-hour reaction period, the ball is removed from the test oil and the amount of corrosion on the ball is quantified using a light reflectance technique. The amount of reflected light is reported as an average gray value (AGV). The AGV for a fresh un-corroded ball is approximately 140. A totally corroded ball has an AGV result of less than 20. A lubricating oil composition which gives an AGV of at least 100 passes the BRT. A lubricating oil composition which gives an AGV of less than 100 fails the BRT.

TBN measurements given in the tables below were made using the procedure of ASTM D-2896 and the results are given in mg KOH/g of the finished lubricating oil composition and mg KOH/g of the detergent contribution to the finished lubricating oil composition.

-continued

| Reference Oil C-1 | |
|---|---|
| 770 | phosphorus (ppmw) |
| 850 | zinc (ppmw) |
| 9.0 | Total Base Number ASTM D-2896 (mg KOH/g) |
| 165 | Viscosity Index |

TABLE 4

| Components | C-1 (Reference Oil) | C-2 | C-3 | I-1 | I-2 | C-4 | C-5 |
|---|---|---|---|---|---|---|---|
| Detergent Formulation | CaS | CaS + CaPh | CaS + CaPh | CaS + CaPh + Mg | CaS + CaPh + Mg | CaS + CaPh | CaS + CaPh + Mg |
| Total TBN of lubricant composition | 9.0 | 7.8 | 6.0 | 7.8 | 9.9 | 6.2 | 8.1* |
| Ca Sulfonate[a] | 2320 | 1120 | 740 | 610 | 610 | 740 | 750 |
| Ca Phenate[b] | N/A | 930 | 610 | 500 | 500 | 610 | 620 |
| Mg detergent[c] | N/A | N/A | N/A | 550 | 1190 | N/A | 400 |
| Total TBN contribution of all detergents to the lubricating oil | 6.0 | 5.3 | 3.6 | 5.3 | 8.2 | 3.6 | 5.4 |
| B content (ppm) | 390 | 40 | 50 | 40 | 0 | 40 | 0 |
| Mo content (ppm) | 80 | 100 | 100 | 100 | 40 | 110 | 330 |
| Ratio of ppm Ca/Total TBN of lubricating oil | 270 | 260 | 230 | 140 | 110 | 210 | 170* |
| Ratio of ppm Mg/wt. % Total detergent soap | N/A | N/A | N/A | 940 | 1600 | N/A | 680 |
| Ball Rust Test | Pass | Fail | Fail | Pass | Pass | Fail | Not run |
| Normalized R-LSPI | 1.00 | 1.12 | 0.03 | 0.05 | 0.03 | 0.05 | 0.15 |

[a]Treat rate indicated by ppm Ca of an Overbased Ca Sulfonate. Target 300 TBN.
[b]Treat rate indicated by ppm Ca of an Overbased Ca Phenate. 250 TBN.
[c]Treat rate indicated by ppm Mg of an Mg Sulfonate. Target 400 TBN.
*Calculated and not measured.

The above-data shows that the inventive formulations of examples I-1 and I-2 had not only good LSPI performance, but also had corrosion resistance as well as evidenced by passing the Ball Rust Test.

Oils, C-1 and C-2 are included as reference oils to demonstrate the current state of the art. Reference oil C-1 was formulated from about 80.7 wt. % of a Group III base oil, about 12.1 wt. % of HiTEC® 11150 PCMO Additive Package available from Afton Chemical Corporation and about 7.2 wt. % of a 35 SSI ethylene/propylene copolymer viscosity index improver. HiTEC® 11150 passenger car motor oil additive package is an API SN, ILSAC-GF-5, and ACEA A5/B5 qualified DI package. Reference oil C-1 also showed the following and properties and partial elemental analysis:

| Reference Oil C-1 | |
|---|---|
| 10.9 | Kinematic Viscosity at 100° C., ($mm^2$/sec) |
| 3.3 | TBS, APPARENT VISCOSITY, cPa |
| 2400 | calcium (ppmw) |
| <10 | magnesium (ppmw) |
| 80 | molybdenum (ppmw) |

Comparative test oil C-2 contains only calcium-containing detergents at a higher calcium loading than the tested inventive oils.

As shown in Table 4, there is a significant improvement in the LSPI Ratio when the overbased magnesium detergent is included in the lubricant composition. Comparing inventive examples I-1 and I-2 with comparative example C-2, there is at least a 96% improvement in LSPI performance. The improvement shown by I-1 over C-2 shows the inventive use of a balance of total TBN of the lubricating oil composition with the selection of the detergent system to achieve both a good LSPI ratio and pass the Ball Rust test.

It is also shown in Table 4 that adding a magnesium-containing detergent to the lubricating oil composition gives a boost to the TBN. Lubricating oil compositions of the present invention can have a TBN of greater than 7.0 mg KOH/g of the lubricating oil composition. Upon comparing inventive examples I-1 and I-2 which include a magnesium-containing detergent and having a total TBN of the lubricating oil composition of 7.8 and 9.9 mg KOH/g of the lubricating oil composition, respectively with comparative example C-3 which does not include a magnesium-containing detergent and has a total TBN of 6.0 mg KOH/g of the lubricating oil composition, it is shown how to achieve the passage of the Ball Rust test and the desired LSPI ratio by using a combination the total TBN of the lubricating oil composition and the selection of a detergent formulation.

Upon comparing inventive example I-1, which has a ratio of the amount of calcium in ppm to the TBN of the lubricant composition of less than 170, there is an improvement in the LSPI performance when compared to comparative example C-4 which has an estimated ratio of the amount of calcium in ppm to the TBN of the lubricant composition of 210. In addition, upon comparing inventive example I-1, which has a ratio of magnesium in ppm to total soap content in wt. % of greater than 700 in the lubricant composition, there is an improvement in the LSPI performance when compared to comparative example C-5 which has a ratio of magnesium in ppm to total soap content in wt. % of 680.

Upon comparing inventive example I-2, which has a ratio of the amount of calcium in ppm to the TBN of the lubricant composition of less than 170, there is an improvement in the LSPI performance when compared to comparative example C-5 which has a ratio of the amount of calcium in ppm to the TBN of the lubricant composition of 170. In addition, upon comparing inventive example I-2, which has a ratio of magnesium in ppm to total soap content in wt. % of greater than 700 in the lubricant composition, there is an improvement in the LSPI performance when compared to comparative example C-5 which has a ratio of magnesium in ppm to total soap content in wt. % of 680.

The Ball Rust Test results show that the inventive formulation has corrosion resistance. Both comparative examples C-3 and C-4, which did not have a magnesium detergent and had low amounts of total detergent and had low TBN for the lubricating oil composition, failed to pass the Ball Rust Test. On the other hand, inventive examples I-1 and I-2 which had a magnesium detergent and had larger amounts of total detergent and higher TBN for the lubricating oil composition, were able to pass the Ball Rust test while still achieving very low LSPI ratios.

It was surprising to find that the inventive examples I-1 and I-2 were able to not only show good LSPI performance, but were also able to pass the Ball Rust Test, unlike comparative examples C-3 and C-4, which only showed good LSPI performance. As such, it was only the inventive formulations of examples I-1 and I-2 which had not only good LSPI performance, but had corrosion resistance as well.

At numerous places throughout this specification, reference has been made to a number of U.S. Patents and other documents. All such cited documents are expressly incorporated by reference in full into this disclosure or at least for the specific purpose for which the document was cited, as if fully set forth herein.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope of the disclosure being indicated by the following claims.

The foregoing embodiments are susceptible to considerable variation in practice. Accordingly, the embodiments are not intended to be limited to the specific exemplifications set forth hereinabove. Rather, the foregoing embodiments are within the scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

It is to be understood that each component, compound, substituent or parameter disclosed herein is to be interpreted as being disclosed for use alone or in combination with one or more of each and every other component, compound, substituent or parameter disclosed herein.

It is also to be understood that each amount/value or range of amounts/values for each component, compound, substituent or parameter disclosed herein is to be interpreted as also being disclosed in combination with each amount/value or range of amounts/values disclosed for any other component(s), compounds(s), substituent(s) or parameter(s) disclosed herein and that any combination of amounts/values or ranges of amounts/values for two or more component(s), compounds(s), substituent(s) or parameters disclosed herein are thus also disclosed in combination with each other for the purposes of this description.

It is further understood that each range disclosed herein is to be interpreted as a disclosure of each specific value within the disclosed range that has the same number of significant digits. Thus, a range of from 1-4 is to be interpreted as an express disclosure of the values 1, 2, 3 and 4.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A lubricating oil composition comprising:

greater than 50 wt. % of a base oil of lubricating viscosity, based on a total weight of the lubricating oil composition;

one or more overbased calcium sulfonate detergents having a total base number of greater than 225 mg KOH/g, measured by the method of ASTM D-2896;

one or more overbased calcium phenate detergents having a total base number of greater than 170 mg KOH/g, measured by the method of ASTM D-2896; and one or more overbased magnesium-containing detergents; and;

wherein a ratio of the amount of calcium in ppm by weight, based on the total weight of the lubricating oil composition to a total base number of the lubricating oil composition measured by the method of ASTM D-2896, is less than 170;

a ratio of magnesium in ppm by weight, based on a total weight of the lubricating oil composition, to total soap content in wt. %, based on a total weight of the lubricating oil composition, is greater than 700;

an amount of boron in the lubricating oil composition is up to 75 ppm by weight, based on the total weight of the lubricating oil composition; and an amount of molybdenum in the lubricating oil composition is less than 330 ppm by weight, based on the total weight of the lubricating oil composition.

2. The lubricating oil composition of claim 1, wherein the base oil is at least one selected from the group consisting of a Group II base oil, a Group III base oil, a Group IV base oil and a Group V base oil.

3. The lubricating oil composition of claim 1, wherein the lubricating oil composition is an engine oil composition and is effective to reduce a number of low-speed pre-ignition events in a boosted internal combustion engine lubricated with the engine oil composition relative to a number of low-speed pre-ignition events in the same engine lubricated with reference lubricating oil C-1.

4. The engine oil composition of claim 3, wherein the reduction in the number of low-speed pre-ignition events is greater than a 50% reduction and the low-speed pre-ignition events are low-speed pre-ignition counts during 25,000 engine cycles, wherein the engine is operated at 2000 revolutions per minute with a brake mean effective pressure of 1,800 kPa.

5. The engine oil composition of claim 3, wherein the reduction in the number of low-speed pre-ignition events is greater than an 85% reduction and the low-speed pre-ignition events are low-speed pre-ignition counts during 25,000 engine cycles, wherein the engine is operated at 2000 revolutions per minute with a brake mean effective pressure of 1,800 kPa.

6. The lubricating oil composition of claim 1, wherein the one or more overbased magnesium-containing detergents have a total base number of greater than 225 mg KOH/g and are selected from the group consisting of an overbased magnesium sulfonate detergent, an overbased magnesium phenate detergent, an overbased magnesium salicylate detergent and mixtures thereof.

7. The lubricating oil composition of claim 1, wherein the total magnesium provided to the lubricating oil composition by the overbased magnesium detergent is from 100 ppm to 1500 ppm, by weight, based on the total weight of the lubricating oil composition.

8. The lubricating oil composition of claim 1, wherein the total calcium provided to the lubricating oil composition by the combination of the one or more overbased calcium phenate and the one or more overbased calcium sulfonate detergents is from 800 ppm to 2400 ppm, by weight, based on the total weight of the lubricating oil composition.

9. The lubricating oil composition of claim 1, wherein the lubricating oil composition has a total base number of greater than 7.0 mg KOH/g of the lubricating oil composition.

10. The lubricating oil composition of claim 1, wherein the ratio of calcium in ppm to the total base number of the lubricating oil composition is 50 to 165.

11. The lubricating oil composition of claim 1, wherein the ratio of magnesium in ppm to total soap content in wt. % is 700 to 2500.

12. The lubricating oil composition of claim 1, wherein the amount of molybdenum in the lubricating oil composition is from 1 to 200 ppm by weight.

13. The lubricating oil composition of claim 1, wherein a total TBN contribution of all detergents to the lubricating oil composition is greater than 4.5 mg KOH/g of the lubricating oil composition.

14. The lubricating oil composition of claim 1, wherein the lubricating oil composition is an engine oil composition that passes the Ball Rust test, as determined by the method of ASTM D-6557.

15. A method for reducing a number of low-speed pre-ignition events in a boosted internal combustion engine comprising steps of:

lubricating a boosted internal combustion engine with a lubricating oil composition comprising:

greater than 50 wt. % of a base oil of lubricating viscosity, based on a total weight of the lubricating oil composition;

one or more overbased calcium sulfonate detergents having a total base number of greater than 225 mg KOH/g, one or more overbased calcium phenate detergents having a total base number of greater than 170 mg KOH/g, and one or more overbased magnesium-containing detergents; and wherein a ratio of an amount of calcium in ppm to a total base number of the lubricating oil composition measured by the method of ASTM D-2896 is less than 170;

a ratio of magnesium in ppm by weight, based on a total weight of the lubricating oil composition to total soap content in wt. %, based on a total weight of the lubricating oil composition is greater than 700;

an amount of boron in the lubricating oil composition is up to 75 ppm by weight, based on a total weight of the lubricating oil composition; and an amount of molybdenum in the lubricating oil composition is less than 330 ppm by weight, based on a total weight of the lubricating oil composition; and operating the engine lubricated with the lubricating oil composition.

16. The method of claim 15, wherein the lubricating oil composition is an engine oil composition which passes a Ball Rust Test according to ASTM D6557 and the number of low-speed pre-ignition events in the boosted internal combustion engine lubricated with the engine oil composition are reduced relative to a number of low-speed pre-ignition events in the same engine lubricated with reference lubricating oil C-1.

17. The method of claim 15, wherein the lubricating oil composition is an engine oil composition and the number of low-speed pre-ignition events are based on low-speed preignition counts during 25,000 engine cycles, wherein the engine is operated at 2000 revolutions per minute with a brake mean effective pressure of 1,800 kPa.

18. The method of claim 15, wherein an amount of the one or more magnesium-containing detergents is not more than 2 wt. %, based on the total weight of the lubricating oil composition.

19. The method of claim 15, wherein an amount of overbased calcium sulfonate and an amount of overbased calcium phenate combine to make up not more than 2.0 wt. % of the total weight of the lubricating oil composition.

20. The method of claim 15, wherein the lubricating step lubricates a combustion chamber or cylinder walls of a spark-ignited direct injection engine provided with a turbocharger or a supercharger or spark-ignited port fuel injection internal combustion engine provided with a turbocharger or a supercharger.

21. The method of claim 20, further comprising a step of measuring the number of low-speed pre-ignition events of the internal combustion engine lubricated with the lubricating oil composition.

22. The method of claim 15, wherein the lubricating oil composition has a total base number of greater than 7.0 mg KOH/g of the lubricating oil composition, as measured by the method of ASTM D-2896.

* * * * *